US010138731B2

(12) United States Patent
Freeman

(10) Patent No.: US 10,138,731 B2
(45) Date of Patent: Nov. 27, 2018

(54) FIXED DISPLACEMENT TURBINE ENGINE

(71) Applicant: Bret Freeman, Huntsville, AL (US)

(72) Inventor: Bret Freeman, Huntsville, AL (US)

( * ) Notice: Subject to any disclaimer, the term of this patent is extended or adjusted under 35 U.S.C. 154(b) by 165 days.

(21) Appl. No.: 15/205,831

(22) Filed: Jul. 8, 2016

(65) Prior Publication Data

US 2017/0009581 A1 Jan. 12, 2017

Related U.S. Application Data

(60) Provisional application No. 62/190,105, filed on Jul. 8, 2015.

(51) Int. Cl.

| | |
|---|---|
| ***F01C 11/00*** | (2006.01) |
| ***F01C 1/16*** | (2006.01) |
| ***F01C 21/10*** | (2006.01) |
| ***F01C 21/18*** | (2006.01) |

(52) U.S. Cl.

CPC ..... *F01C 11/004* (2013.01); *F01C 1/16* (2013.01); *F01C 21/108* (2013.01); *F01C 21/18* (2013.01)

(58) Field of Classification Search

CPC ..... F01C 21/18; F01C 21/108; F01C 1/16; F01C 11/004

USPC ..... 123/200–249, 18 A, 18 R, 43 A, 45 A

See application file for complete search history.

(56) References Cited

U.S. PATENT DOCUMENTS

| | | | | |
|---|---|---|---|---|
| 599,648 A * | 2/1898 | Stoner | F04C 23/001 418/9 |
| 1,287,268 A | 12/1918 | Edwards | |
| 1,726,104 A | 8/1929 | Harris | |
| 2,474,653 A * | 6/1949 | Boestad | F04C 18/16 418/201.1 |

(Continued)

FOREIGN PATENT DOCUMENTS

| | | | |
|---|---|---|---|
| CH | 270648 A * | 9/1950 | F01B 17/00 |
| GB | 650606 | 2/1951 | |

(Continued)

OTHER PUBLICATIONS

International Search Report and Written Opinion for International application No. PCT/US16/41574.

(Continued)

*Primary Examiner* — Jason Newton

(74) *Attorney, Agent, or Firm* — Angela Holt; Bradley Arant Boult Cummings LLP

(57) ABSTRACT

An engine comprises a compression portion and a combustion portion. The compression portion comprises twin-screw rotors, male engaged with female. The combustion portion comprises twin-screw rotors, male engaged with female. The male compression rotor and the male combustion rotor share a same longitudinal axis, and the female compression rotor and the female combustion rotor share a same longitudinal axis. A combustion plate is disposed between the compression portion and the combustion portion, and prevents flow of gas from the compression portion to the combustion portion, except through a small orifice centrally (Continued)

located on the combustion plate. A valve is affixed to the male rotors adjacent to the combustion plate, covering the lobes of the male rotors and extending beyond the lobes of the male rotors. The valve controls the flow of gas from the compression portion to the combustion portion.

19 Claims, 7 Drawing Sheets

(56) References Cited

U.S. PATENT DOCUMENTS 2,485,687 A * 10/1949 Bailey ..... F02B 53/00 123/204
2,511,441 A 6/1950 Loubiere
2,553,548 A * 5/1951 Pawl ..... F01C 1/107 123/241
2,622,787 A * 12/1952 Nilsson ..... F01C 1/084 418/116
2,627,161 A * 2/1953 Lindhagen ..... F01B 17/00 123/204
2,709,336 A * 5/1955 Nilsson ..... F01C 11/006 123/204
2,804,260 A * 8/1957 Nilsson ..... F04C 18/16 123/204
2,808,813 A * 10/1957 Lindhagen ..... F01D 5/08 123/204
2,845,777 A * 8/1958 Nilsson ..... F01C 20/16 123/204
3,175,359 A 3/1965 Szlechter
3,214,907 A * 11/1965 Martin ..... F01C 11/004 123/249
3,518,975 A * 7/1970 Schmidt ..... F02B 53/00 123/204
3,693,601 A * 9/1972 Sauder ..... F01C 1/16 123/203
3,940,925 A 3/1976 Kelley
4,222,231 A 9/1980 Linn
4,487,176 A * 12/1984 Kosheleff ..... F01C 1/16 123/204
4,673,344 A * 6/1987 Ingalls ..... F01C 1/084 418/150
4,758,132 A * 7/1988 Hartwig ..... F01C 1/16 310/67 R
4,825,827 A * 5/1989 Yang ..... F01C 11/004 123/222
4,971,002 A * 11/1990 Le ..... F01C 11/004 123/238
5,222,992 A * 6/1993 Fleischmann ..... F01C 11/004 123/204
5,429,083 A * 7/1995 Becker ..... F02B 53/02 123/222
5,605,124 A * 2/1997 Morgan ..... F01C 11/004 123/222
6,257,195 B1 * 7/2001 Vanmoor ..... F01C 3/02 123/239
6,487,843 B1 * 12/2002 Tomczyk ..... F01C 1/16 60/39.45
6,606,973 B2 8/2003 Moe
6,672,065 B1 1/2004 Choroszylow et al.
7,530,217 B2 5/2009 Murrow et al.
7,624,565 B2 12/2009 Murrow et al.
7,690,482 B2 4/2010 Shoulders
7,726,115 B2 6/2010 Murrow et al.
7,784,303 B2 8/2010 Sakitani et al.
8,555,611 B2 10/2013 Vanmoor
8,616,176 B2 12/2013 Jacobsen et al.
2003/0012675 A1 1/2003 Perna
2004/0261759 A1 * 12/2004 Greppi ..... F01K 21/04 123/246
2005/0223734 A1 10/2005 Smith et al.
2009/0308347 A1 12/2009 Hathaway et al.
2010/0021331 A1 1/2010 Hruschka

FOREIGN PATENT DOCUMENTS

GB 889246 2/1962
JP S58160515 9/1983

OTHER PUBLICATIONS

International Search Report and Written Opinion dated Oct. 5, 2016 in corresponding International Application No. PCT/US2016/41574 filed Jul. 8, 2016, 17 pages.

* cited by examiner

FIXED DISPLACEMENT TURBINE ENGINE

REFERENCE TO RELATED APPLICATIONS

This application claims the benefit of and priority to U.S. Provisional patent application Ser. No. 62/190,105, entitled "Fixed Displacement Turbine" and filed on Jul. 8, 2015, which is fully incorporated herein by reference in its entirety.

BACKGROUND & SUMMARY

An engine comprises a compression portion and a combustion portion. The compression portion comprises twin-screw rotors, male engaged with female. The combustion portion comprises twin-screw rotors, male engaged with female. The male compression rotor and the male combustion rotor share a same longitudinal axis, and the female compression rotor and the female combustion rotor share a same longitudinal axis. A combustion plate is disposed between the compression portion and the combustion portion, and prevents flow of gas from the compression portion to the combustion portion, except through a small orifice centrally located on the combustion plate. A valve is affixed to ale rotors adjacent to the combustion plate, covering the lobes of the male rotors and extending beyond the lobes of the male rotors. The valve controls the flow of gas from the compression portion to the combustion portion.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

Figure 1:
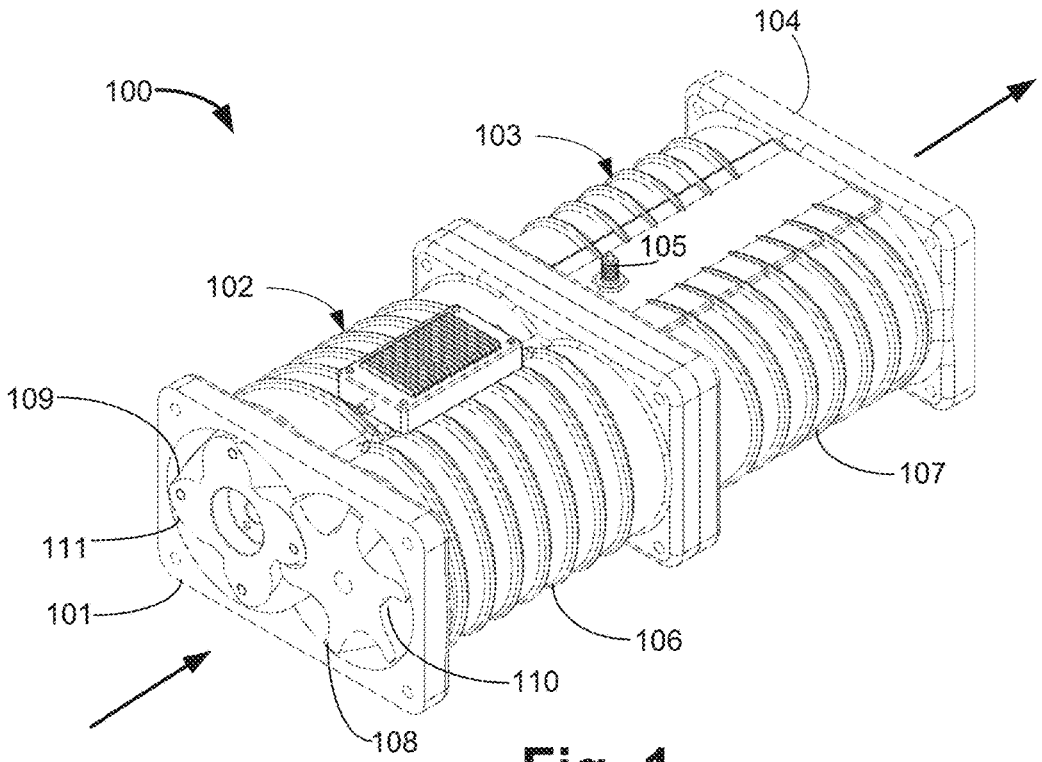
FIG. 1 is a perspective view of an engine according to an exemplary embodiment of the present disclosure.

Repeat use of reference characters throughout the present specification and appended drawings is intended to represent the same or analogous features or elements of the invention.

DETAILED DESCRIPTION

FIG. 1 is a perspective view of an engine 100 according to an exemplary embodiment of the present disclosure. The engine 100 comprises an inlet 101, compression portion 102, a combustion portion 103, and an exhaust 104. The compression portion 102 is adjacent to the combustion portion 103. The compression portion 102 comprises a compression housing 106, which encloses twin-screw compression rotors comprising a male compression rotor 109 and a female compression rotor 108.

The male rotor 109 comprises helically-extending lobes 111 that engage with a plurality of helically-grooved flutes 110 on the female compression rotor 108. In the illustrated embodiment, the male compression rotor 109 has four lobes 111. In this embodiment, the lobes 111 of the male rotor 109 are each spaced 90 degrees apart, and extend helically around the rotor approximately 180 degrees over eight (8) inches of length, which amounts to 22.5 degrees of rotation per inch. The pitch of the rotor lobes is chosen to maximize compression and combustion for a variety of fuels and desired RPM ranges. Other embodiments employ other angles of extension around the rotor. In one embodiment, the pitch of the lobes is between 10 degrees per inch and 50 degrees per inch.

In the illustrated embodiment, the female rotor 108 has six flutes 110. The flutes 110 of the female rotor 108 are spaced 60 degrees apart and the pitch is directly related to that of the male rotor 110. With a flute-to-lobe ratio of 6 to 4 in the illustrated embodiment, the pitch of the female rotor 108 would be the pitch of the male rotor divided by their ratio to each other, or 180°/1.5=120°.

Although the illustrated embodiment discloses a male rotor with four lobes and a female rotor with six flutes, it is understood that other embodiments may use different numbers of lobes and flutes without departing from the scope of the present disclosure.

The combustion portion 103 comprises a combustion housing 107, which encloses twin screw combustion rotors (not shown) substantially similar to those in the compression portion 102. The combustion portion 103 further comprises a spark generator or injector 105.

In the illustrated embodiment, the rotors 108 and 110 are formed from steel, as are the combustion housing 107 and compression housing 106. Other suitable materials may be used in other embodiments, depending upon the use of the engine. Exemplary materials include titanium, composite materials, ceramics, and aluminum.

Figure 2:
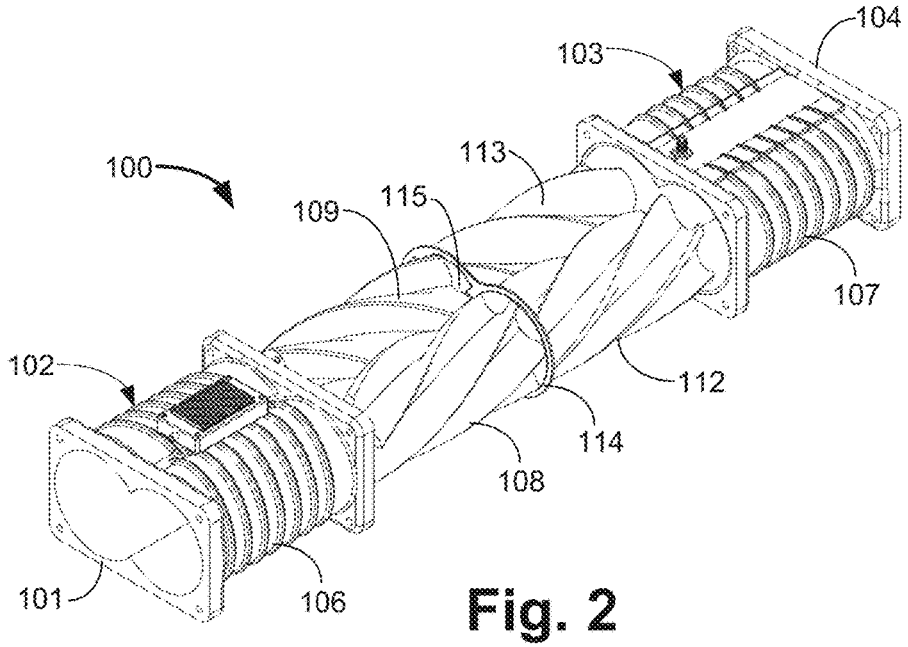
FIG. 2 is a partially exploded view of the engine of FIG. 1.

FIG. 2 is a partially exploded view of the engine 100 of FIG. 1, showing the female compression rotor 108 and male compression rotor 109 removed from the compression housing 106, and further showing a female combustion rotor 112 and a male combustion rotor 113 removed from the combustion housing 107. A combustion plate 114 separates the compression rotors 108 and 109 from the combustion rotors 112 and 113. An orifice (not shown) in the compression plate 114 allows compressed gas to pass from compression rotors 108 and 109 to the combustion rotors 112 and 113. A compression valve 115 at an outlet end of the male compression rotor 109 controls the flow of gas from the compression rotors 108 and 109 to the combustion rotors 112 and 113, as further discussed herein.

Figure 3:
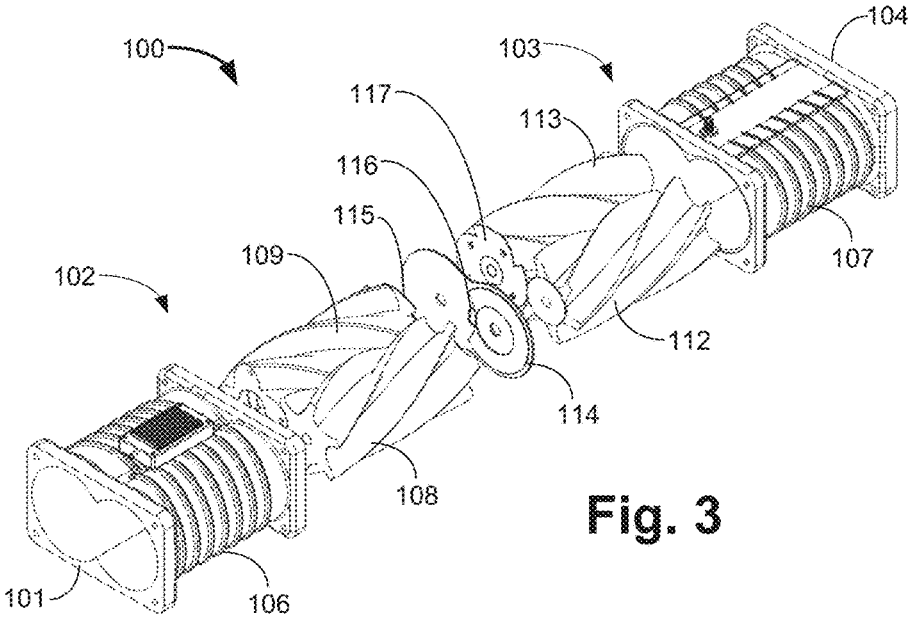
FIG. 3 is an exploded view of the engine of FIG. 1.

FIG. 3 is a fully exploded view of the engine 100 of FIG. 1, depicting the compression rotors 108 and 109 and combustion rotors 112 and 113 fully removed from their housings 106 and 107, respectively. The combustion plate 114 is disposed between the compression rotors 108 and 109 and the combustion rotors 112 and 113, and comprises an orifice 116 through which gas passes from the compression portion 102 to the combustion portion 103. The compression valve 115 is affixed to the male compression rotor 109 and engages with the combustion plate 114 as further discussed herein. A combustion valve 117 is affixed to the male combustion rotor 113 and engages with the combustion plate 114 as further discussed herein.

Figure 4:
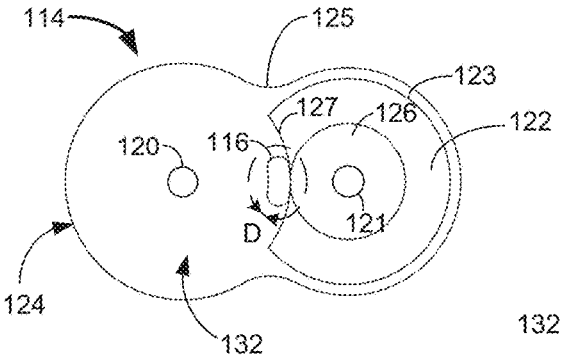
FIG. 4 is a front side plan view of a combustion plate according to an exemplary embodiment of the present disclosure.

FIG. 4 is a plan view of a front side of the combustion plate 114 of FIG. 3. The rear side of the combustion plate 114 is substantially a mirror image of the front side. The combustion plate 114 is a thin plate, formed from steel in one embodiment. The combustion plate 114 comprises openings 120 and 121 which receive rods (not shown) that connect the rotors together. In this regard, one rod (not shown) passes through the male compression rotor 109 (FIG. 3), through the opening 120, and through the male combustion rod 113 (FIG. 3), and another rod (not shown) passes through the female compression rotor 108 (FIG. 3), through the opening 121, and through the female combustion rotor 112 (FIG. 3).

The combustion plate 114 has a perimeter 124 that follows the curves of the rotors, and in this regard is shaped as two semicircles joined together, with a concave portion 125 of the perimeter joining two circular portions. A flat portion 132 on the front side of the combustion plate 114 contacts the compression valve 115. A raised portion 122 comprises a semi-circular raised area with a recession 126 in the middle. The recession 126 receives a protrusion (not shown) on the female rotors. The raised portion 122 is raised 0.05" in one embodiment, but other dimensions may be used in other embodiments. The raised portion 122 has a perimeter comprising a circular portion 123 and an arc-shaped portion 127. The arc-shaped portion 127 bounds the footprint of the compression valve 115 and the combustion valve 117.

The orifice 116 is disposed near the center of the combustion plate 114, in the area where the footprint of the male rotors 109 and 113 overlaps the footprint of the female rotors 108 and 112. One edge of the orifice 116 follows the curve of the arc-shaped portion 127, as further discussed herein.

Figure 5:
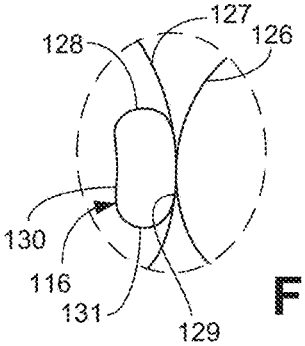
FIG. 5 is an enlarged detail view of the orifice of the combustion plate of FIG. 4, taken along detail line "D" of FIG. 4.

FIG. 5 is an enlarged view of the orifice 116 of FIG. 4, taken along detail line "D" of FIG. 4. The orifice 116 comprises a somewhat kidney-shaped opening extending through the combustion plate 114 (FIG. 4). The orifice 116 comprises a convex outer edge 129 that aligns with the arc-shaped portion 127, which bounds an outer edge of the footprint of the valves 115 and 117. The orifice 116 further comprises a concave edge 130 opposite from the convex outer edge 128. An upper edge 128 and a lower edge 131 of the orifice 116 are arc-shaped. In other embodiments, the orifice 116 may be differently-shaped.

Figure 6:
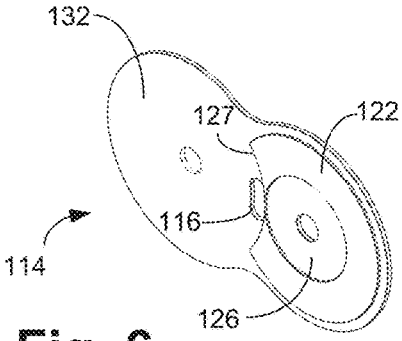
FIG. 6 is a perspective view of the combustion plate of FIG. 4.

FIG. 6 is a perspective view of the combustion plate of FIG. 4. The outer perimeter of the recession 126 is substantially circular, and slightly larger than a substantially circular protrusion (not shown) on the female rotors 108 and 112. In this regard, the recession 126 receives the protrusions of the female rotors 108 and 112.

Figure 7:
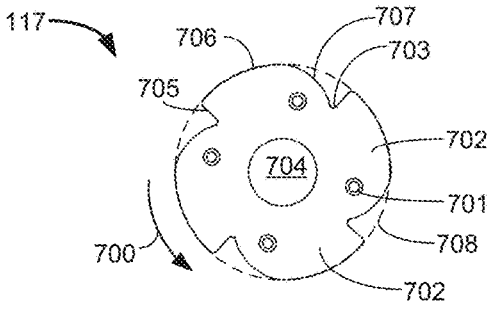
FIG. 7 is a front side plan view of a valve according to an exemplary embodiment of the present disclosure.

FIG. 7 is a front plan view of the valve 117, which is substantially similar to the compression valve 115. The combustion valve 117 comprises four petals 702, equally-spaced apart from one another around the perimeter of the valve 117. Each petal 702 corresponds with and covers a lobe 111 of the male rotor, as further discussed herein with respect to FIG. 9. The valve 117 rotates in the direction indicated by directional arrow 700, or counter-clockwise.

A recession 703 is disposed between each pair of petals 702. The recessions 703 are partially coextensive with the lobes of the male rotor 113 (FIG. 9), as further discussed herein. Other embodiments may have a different number of petals 702 on the valve; however, the number of petals 702 generally equals the number of lobes 111 (FIG. 9) on the male rotors.

Each petal 702 comprises a radial edge 705 that extends generally radially from a center of the valve 117. Each petal 702 further comprises a perimeter edge 706 that is generally coextensive with a circular footprint 708 of the valve 117 (the footprint 708 shown in dashed lines). Each petal 702 further comprises a lobe-following edge 707 that is substantially aligned with a trailing edge of the lobe 111, as further discussed herein with respect to FIG. 9. The lobe-following edge 707 curves downwardly at the recession 703. The recession 703 is disposed between the lobe-following edge 707 and the radial edge 705 of the adjacent petal 702.

The valve 117 further comprises a central opening 704 extending through the valve 117. The valve 117 further comprises a plurality of openings 701 for receiving fasteners (not shown). In this regard, the valve 117 may be releasably affixed to the male rotor 113 via a plurality of standard fasteners, such as screws. When the valve 117 is releasably affixed to the male rotor 113, the valve can be removed and replaced when it is worn, without a need to replace the rotor. In other embodiments, the valve 117 may be permanently attached to the rotor, by either being machined as one piece with the rotor, or by adhesive, or welding.

Figure 8:
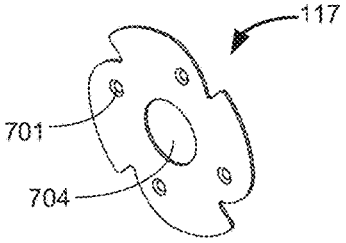
FIG. 8 is a perspective view of the valve of FIG. 7.

FIG. 8 is a perspective view of the valve 117 of FIG. 7. The valve is generally thin, and in one embodiment has a thickness of approximately 0.05". In one embodiment, the valve has an outer diameter of approximately 4.00 inches. The valve 117 comprises a plurality of openings 701 for receiving fasters (not shown) that releasably affix the valve 117 to the male rotor 113 (not shown).

Figure 9:
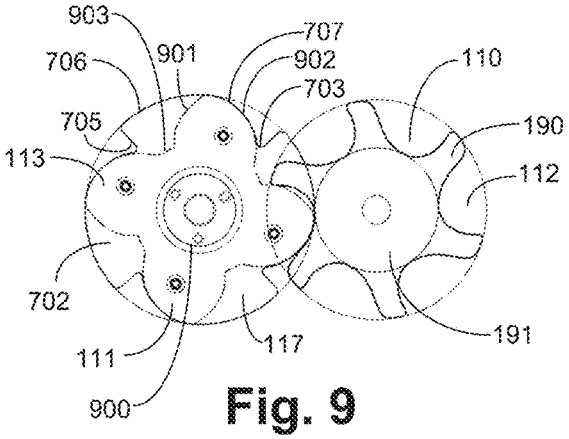
FIG. 9 is a front view of a male rotor and valve engaged with a female rotor, according to an exemplary embodiment of the present disclosure.

FIG. 9 is a front plan view of the valve 117 installed on the male combustion rotor 113, with the female combustion rotor 112 engaged with the male combustion rotor 113. The male combustion rotor 113, which is obscured by the valve 117, is shown in dashed lines for reference.

The valve 115, male compression rotor 109, and female compression rotor 108 are substantially similar to the valve 117, male combustion rotor 113, and female combustion rotor 112. The female rotor 112 comprises a plurality of vanes 190 with flutes 110 disposed between adjacent vanes 190. The vanes 190 comprise helical protrusions on the rotor 112 and the flutes 110 comprise recessions between adjacent protrusions. The flutes 110 receive the lobes 111 of the male rotor 113. A cylindrical protrusion 191 extends from the front end of the female rotor 112 and comprises a front surface that is in substantially the same plane as the front surface of the valve 117. The outer edges of the petals 702 may contact the perimeter of the protrusion 191 when the rotors are rotating, in some embodiments. Further, the protrusion 191 is received by the recession 126 (FIG. 6) of the combustion plate 114.

The male combustion rotor 113 comprises a circular protrusion 900 extending from the end that engages with the central opening 704 (FIG. 7) of the valve 117. In this regard, the protrusion 900 fits within the central opening 704 to help keep the valve 117 centered on the male rotor 113.

Each lobe 111 of the male combustion rotor 113 comprises a leading edge 901 that curves to a trailing edge 902, with recessions 903 disposed between adjacent lobes 111. Each petal 702 of the valve 117 corresponds with and covers a lobe 111 of the male combustion rotor 113. Further, the radial edge 705 and perimeter edge 706 of the valve 117 extend beyond the leading edge 901 of the lobe 111. The trailing edge 902 of the lobe 111 is substantially aligned with the lobe-following edge 707 of the valve 117, though the trailing edge 902 of the lobe 111 ends at the recession 703 before it reaches the recession 903 of the lobe 111. In other words, the recession 703 of the valve 117 is disposed outwardly from the recession 903 of the lobe 111.

Figure 10:
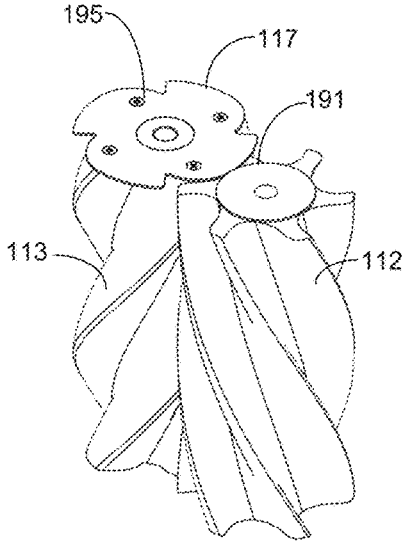
FIG. 10 is a perspective view of the male rotor, valve and female rotor of FIG. 9.

FIG. 10 is a perspective view of the valve 117, male combustion rotor 113, and female combustion rotor 112 of FIG. 9. The protrusion 191 extends from the end of the female rotor 113, and is integral with the female rotor in the illustrated embodiment. The valve 117 is releasably affixed to the male rotor 113 via a plurality of fasteners 195.

Figure 11:
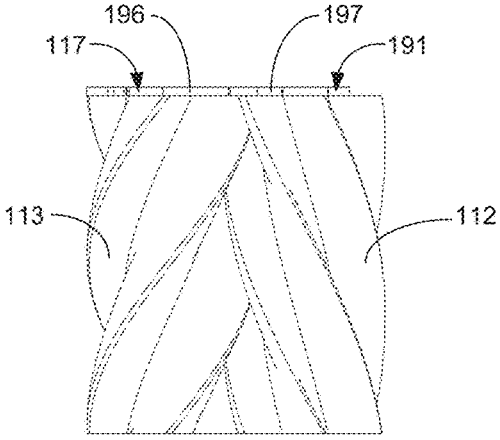
FIG. 11 is a top plan view of the male rotor, valve and female rotor of FIG. 9.

FIG. 11 is a top plan view of the male rotor, valve and female rotor of FIG. 9. The female protrusion 191 extends from the female rotor 112 approximately 0.05" inches in one embodiment. Further a top surface 197 of the female rotor 112 is in substantially the same plane as a top surface 196 of the valve 117 when the valve 117 is installed on the male rotor 113.

Figure 12:
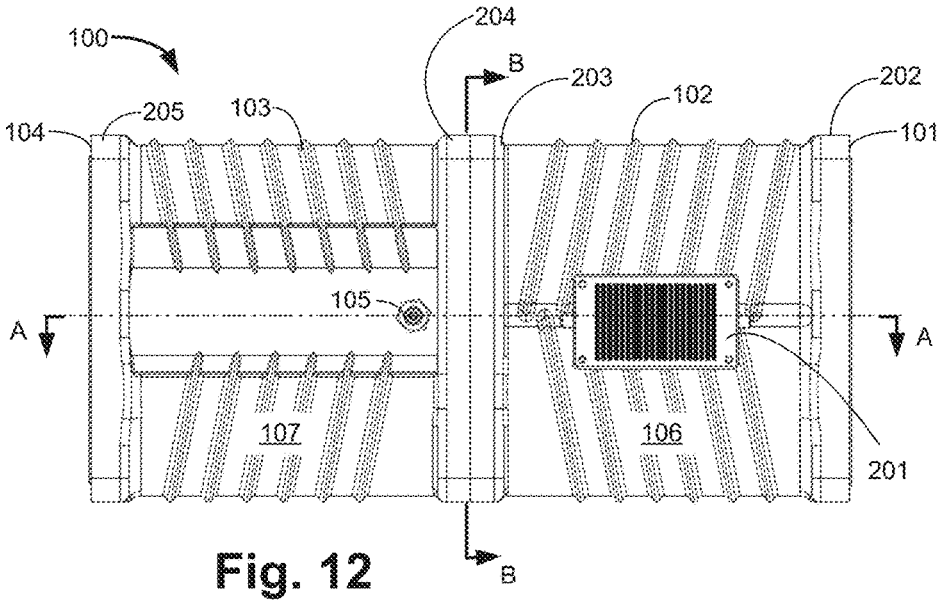
FIG. 12 is a top plan view of the engine of FIG. 1.

FIG. 12 is a top plan view of the engine 100 of FIG. 1. An electronic control module 201 is disposed on the compression housing 106, and the spark plug 105 is disposed on the combustion housing 107. An inlet flange 202 connects the engine compression housing 106 to the intake (not shown). And outlet flange 205 connects the combustion housing 107 to the exhaust (not shown). Central flanges 203 and 204 connect the compression housing 106 to the combustion housing 107 in the illustrated embodiment. Other embodiments do not have central flanges 203 and 204, and in such embodiments the compression housing 106 and combustion housing 107 are machined as one housing, and not separate.

Figure 13A:
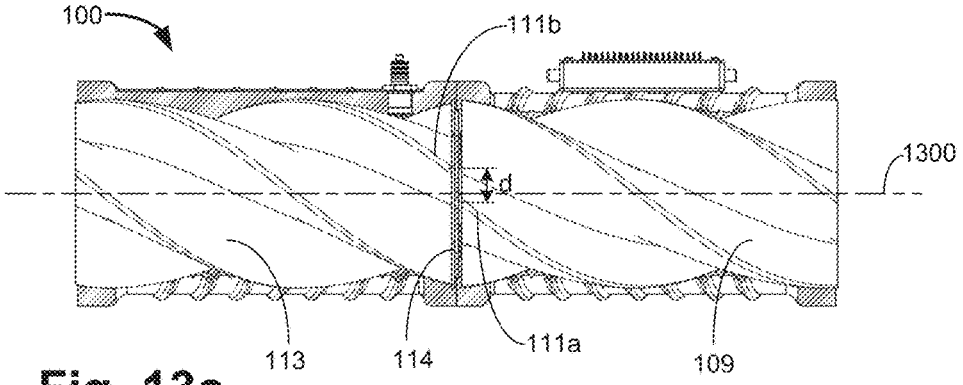
FIG. 13*a* is a partial cross-sectional view of the engine of FIG. 12, taken along section lines "A-A" of FIG. 12.

FIG. 13*a* is a partial cross sectional view of the engine of FIG. 12, taken along section "A-A" of FIG. 12. The male compression rotor 109 shares a same longitudinal axis 1300 as the male combustion rotor 113. Similarly, the female compression rotor 108 (not shown) shares a same longitudinal axis as the female combustion rotor 112 (not shown). In this regard, the female compression rotor 108 rotates around a same rod (not shown) as the female combustion rotor 112 and the male compression rotor 109 rotates around a same rod as the male combustion rotor 113.

FIG. 13*a* further illustrates that the lobes 111*a* of the male compression rotor 109 are clocked differently from the lobes 111*b* of the male combustion rotor 113. In other words, the helically-disposed lobes 111*a* of the male compression rotor are not helically-aligned with the lobes 111*b* of the male combustion rotor. Rather, at the combustion plate 114, where the male compression rotor 109 meets the male combustion rotor 113 (with the combustion plate in between), the lobes 111*a* of the male compression rotor 109 are offset axially from the lobes 111*b* of the male combustion rotor 113 by a distance "d" that corresponds to an angle. Similarly, the vanes (not shown) of the female compression rotor 108 are offset from the vanes (not shown) of the female combustion rotor by a proportional angle.

Figure 13B:
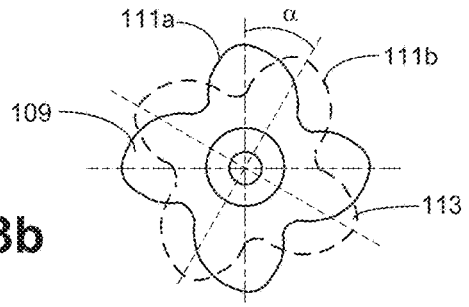
FIG. 13*b* is a representative view of the male compression rotor shown clocked with respect to the male combustion rotor.

FIG. 13*b* is a representative view of the male compression rotor 109 shown clocked with respect to the male combustion rotor 113. The clocking angle $\alpha$ of the lobes 111*a* of the male combustion rotor 109 with respect to the lobes 111*b* of the male compression rotor 113 is set to fix the timing of the two chambers to get the desired combustion. A fixed volume of gas transferred from the compression side of the engine to the combustion side of the engine. As the lobes and vanes close on the compression side, the lobes and vanes on the combustion side open to finish the transfer of gas. Setting the clocking angle $\alpha$ at a desired angle sets the amount of air that is getting shifted from the compression side to the combustion side in a single rotation. The timing of the engine can thus be varied during the engine build to vary the compression from lower RPM to higher RPM operation. The greater the angle $\alpha$, the more air is transferred. In one embodiment the angle "$\alpha$" is between 20 and 60 degrees.

Figures 14A, 14B, 14C, 14D:
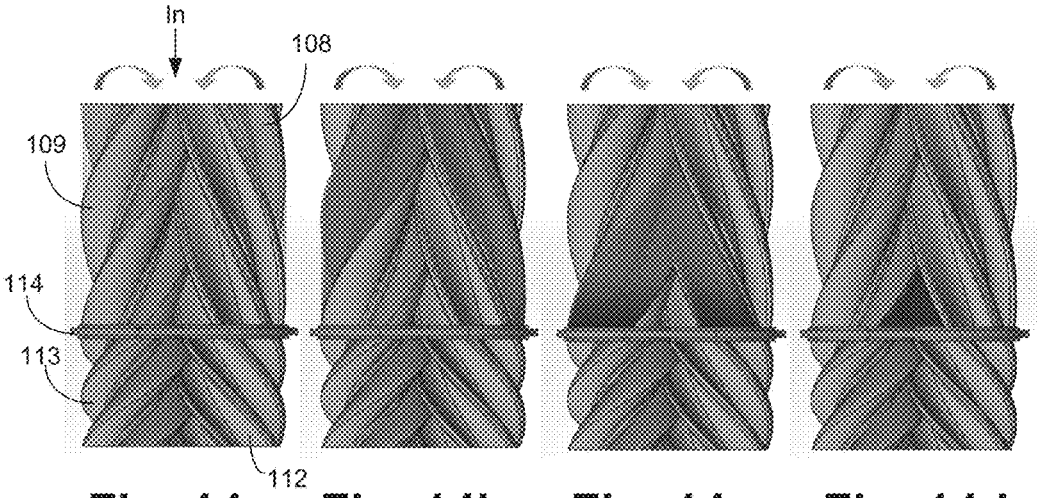
FIG. 14*a* depicts air entering the intake side of an engine according to an exemplary embodiment of the present disclosure.
FIG. 14*b* depicts the air of FIG. 14*a* beginning to be compressed as the rotors rotate.
FIG. 14*c* depicts the compression of FIG. 14*a* continuing.
FIG. 14*d* depicts the compressed air of FIG. 14*a* being forced through the orifice in the compression plate.

FIGS. 14*a*-14*d* illustrate the compression cycle of the engine, looking at a side view of the rotors 108, 109, 112, and 113. Air is pulled into the intake rotors by negative pressure displacement. The air is compressed by the interlocking rotation of the male rotor 109 engaging with the female rotor 108. FIG. 14*a* depicts the air (in blue) entering the intake side of the engine. FIG. 14*b* depicts the air beginning to be compressed as the rotors rotate. FIG. 14*c* depicts the compression continuing. FIG. 14*d* depicts the compressed air being forced through the orifice 116 (FIG. 3) in the compression plate 114.

Figures 15A, 15B, 15C, 15D:
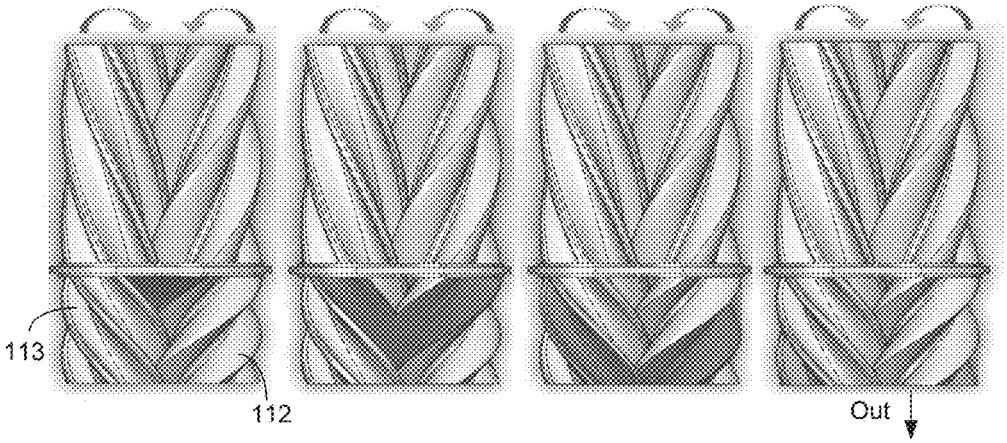
FIG. 15*a*, the compressed air that has been forced through the compression plate ignited by the ignition device.
FIG. 15*b* depicts the combustion stated in FIG. 15*a* continuing.
FIG. 15*c* depicts continued combustion of FIG. 15*b*.
FIG. 15*d* depicts the burned air and fuel being exhausted.

FIGS. 15*a*-15*d* illustrate the combustion cycle of the engine, looking at a side view of the rotors 108, 109, 112, and 113. In FIG. 15*a*, the compressed air that has been forced through the compression plate 114 (shown in red) is ignited by the ignition device 105 (FIG. 3). FIG. 15*b* depicts the combustion continuing. The combustion forces the rotors to turn as the gases expand. FIG. 15*c* depicts the continued combustion. In FIG. 15*d*, the burned air and fuel is exhausted.

Figure 16A:
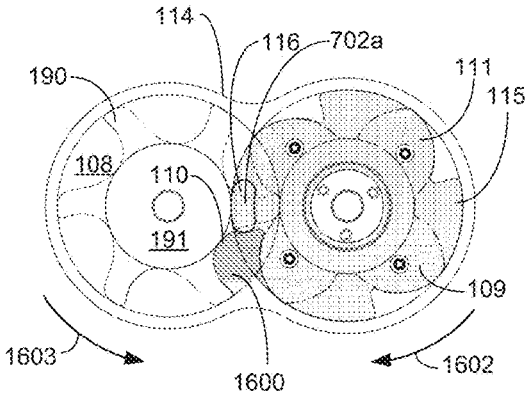
FIG. 16*a* is a cross-sectional view of the engine of FIG. 12, taken along section lines B-B of FIG. 12, at a position of the rotors before gas passes from the compression portion of the engine to the combustion portion.

FIGS. 16*a*-16*d* depict the operation of the compression valve 115 in a section view taken along section lines "B-B"

of FIG. 12. FIG. 16*a* depicts gas 1600 (shown in a patterned area) being compressed by the lobe 111 of the male compression rotor 109 engaging with the flute 110 of the female compression rotor 108. The male compression rotor 109 rotates in the direction indicated by directional arrow 1602 and the female compression rotor 108 rotates in the direction indicated by directional arrow 1603. FIG. 16*a* is a different view of the same step in the process depicted in FIG. 14*d*. The gas 1600 is being compressed, but does not yet have anywhere to go because it has not yet reached the orifice 116 in the combustion plate 114. (Note that the FIGS. 16*a-d* depict the combustion plate 114 as transparent, for the sake of clarity in understanding the process.)

In this position, the petal 702*a* of the valve 117 blocks the orifice 116. As was discussed above with respect to FIG. 9, the radial edge 705 (FIG. 9) and perimeter edge 706 (FIG. 9) of the petal 702 of the valve 115 extend beyond the leading edge 901 of the lobe 111. The portion of the petal 702*a* that extends beyond the leading edge 901 of the lobe 111 blocks the orifice while the rotors 109 and 109 are in the position shown in FIG. 16*a*.

Figure 16B:
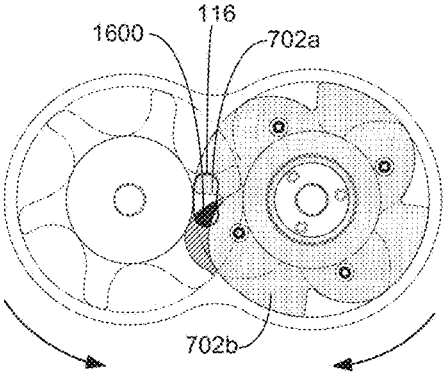
FIG. 16*b* depicts the engine of FIG. 16*a*, with the rotors further rotated such that gas has begun to pass from the compression portion to the combustion portion.

FIG. 16*b* depicts rotors 108 and 109 with the gas 1600 further compressed by the continued rotation of the rotors 108 and 109. When the rotors 108 and 109 turn far enough that the petal 702*a* uncovers the orifice 116, and the recession 703 (FIG. 9) of the valve 115 allows the gas 1600 to begin to pass through the orifice 116 and from the compression side (not shown) of the engine to the combustion side (not shown) of the engine, as depicted in FIG. 15*a* herein. As shown in FIG. 16*b*, the recession 703 is positioned on the valve such that the recession 703 at least partially overlaps the orifice 116 at some point when the rotor is rotating.

Figure 16C:
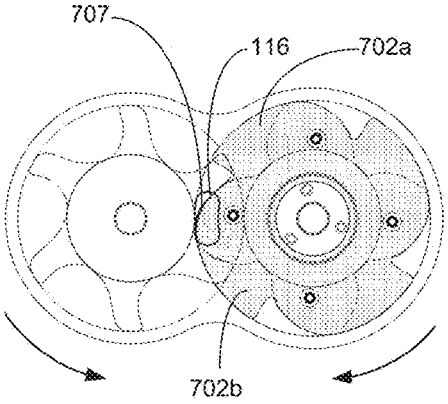
FIG. 16*c* depicts the engine of FIG. 16*b*, with the rotors further rotated such that gas has passed from the compression portion to the combustion portion.

FIG. 16*c* depicts the rotors 108 and 109 in maximum contact with one another. In this regard, the lobe 111 of the male compression rotor 109 is fully received by the flute 110 of the female compression rotor 108. At this point, all of the gas 1600 (FIG. 6*b*) has been compressed through the orifice 116 to the combustion side, and the lobe-following edge 707 of the petal 702*b* of the valve 115 (where 702*b* is the petal adjacent to 702*a*) is more than halfway covering the orifice 116.

Figure 16D:
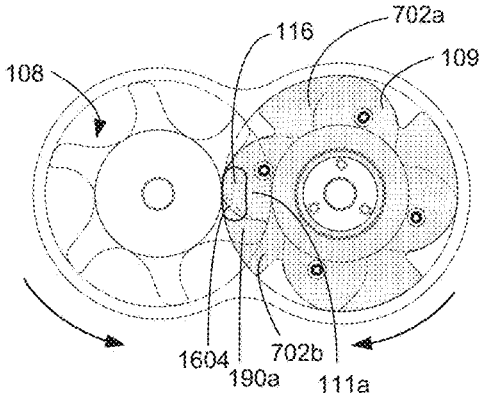
FIG. 16*d* depicts the engine of FIG. 16*c*, with the rotors further rotated.

FIG. 16*d* depicts the rotors 108 and 109 slightly turned from that shown in FIG. 16*c*, such that the lobe 111 has started to disengage from the flute 110, and the petal 702*b* of the valve 115 fully covers the orifice 116 again. Once the petal 702*b* of the valve 115 has closed the orifice 116, gas is prevented from flowing back through the orifice 116 and into the compression portion. As shown in FIG. 16*d*, at this point in the rotation an opening 1604 has begun to develop between the lobe 111*a* of the rotor 109 and the vane 190*a* of the female rotor 108. If there were no valve 115 to cover the orifice 116, gas could flow back into the compression portion. The steps illustrated in FIGS. 16*a-d* repeat as the cycle of compression repeats.

FIGS. 16*a-d* depict the valve 115 on the compression side of the engine. The valve 117 (FIG. 3) on the combustion side operates similarly to let gas into the combustion side of the engine. Other embodiments have only one valve 115 or 117, instead of the two valves 115 and 117 shown in the illustrated embodiment (FIG. 3).

Figure 17:
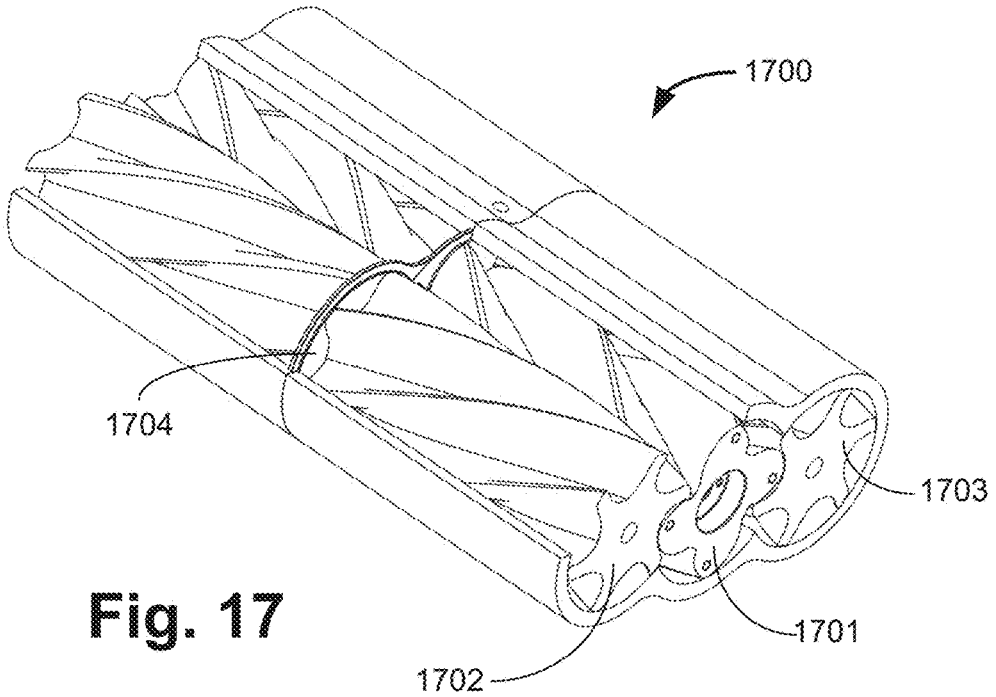
FIG. 17 depicts an alternative embodiment of the engine with a male rotor engaging with two female rotors on both the compression and combustion side of the engine.

FIG. 17 depicts an alternative embodiment of an engine 1700 with a male rotor 1701 engaging with two female rotors 1 and 1703 on both the compression and combustion side of the engine. In this embodiment, the combustion plate 1704 has two orifices (not shown), one between the male rotor 1701 and the female rotor 1702 and one between the male rotor 1701 and the female rotor 1703. This configuration can therefore provide up to twice the combustion of a same-sized embodiment with only one male rotor and one female rotor on each side of the engine.

Figure 18:
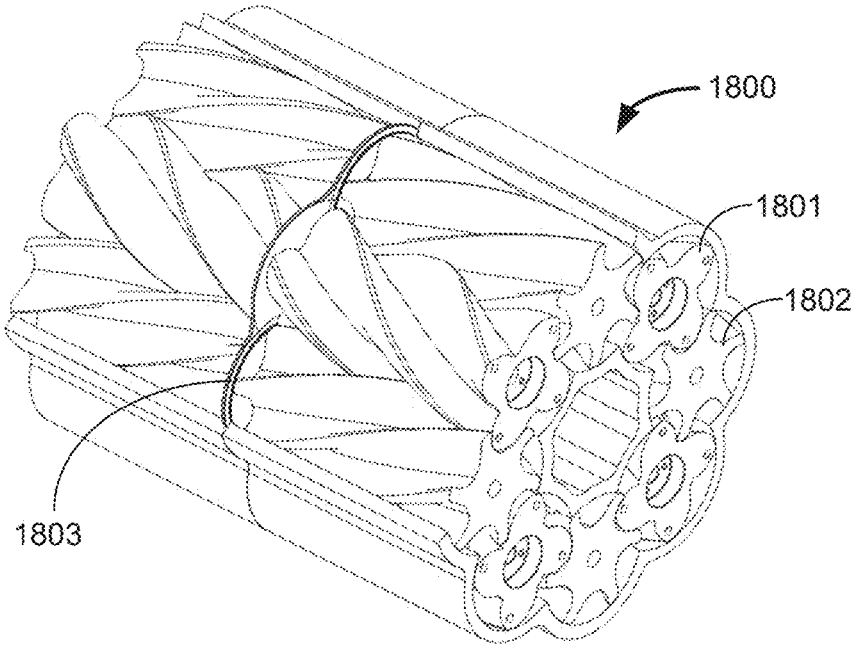
FIG. 18 depicts an alternative embodiment of the engine with four male rotors engaging with four female rotors in a circular configuration.

FIG. 18 depicts an alternative embodiment of an engine 1800 with four male rotors 1801 engaging with four female rotors 1802 in a circular configuration. In this configuration, the combustion plate 1803 has orifices between adjacent male/female pairs, or 8 total orifices, resulting in increased combustion.

What is claimed is:

1. An engine comprising:

a compression portion comprising a male compression screw rotor rotatably engaged with a female compression screw rotor, the male compression screw rotor comprising a plurality of helically-extending lobes and the female compression screw rotor comprising a plurality of helically-arranged flutes, the flutes of the female compression screw rotor receiving the lobes of the male compression screw rotor;

a combustion portion comprising a male combustion screw rotor rotatably engaged with a female combustion screw rotor, the male combustion screw rotor comprising a plurality of helically-extending lobes and the female combustion screw rotor comprising a plurality of helically-arranged flutes, the flutes of the female combustion screw rotor receiving the lobes of the male combustion screw rotor, the male compression screw rotor sharing a longitudinal axis with the male combustion screw rotor and the female compression screw rotor sharing a longitudinal axis with the female combustion screw rotor;

a combustion plate disposed between the compression portion and the combustion portion, the combustion plate comprising a solid plate and an orifice extending through the plate, the solid plate configured to block gas flow between the compression portion and the combustion portion and the orifice configured to permit gas flow from the compression portion to the combustion portion;

a combustion valve affixed to the male combustion screw rotor adjacent to the combustion plate, the combustion valve comprising a thin plate with a plurality of petals, each petal associated with and covering a corresponding lobe of the plurality of helically-extending lobes of the male combustion screw rotor, each petal extending beyond the corresponding lobe of the plurality of helically extending lobes of the male combustion screw rotor, adjacent ones of the plurality of petals of the combustion valve separated from one another by a combustion valve recession, the combustion valve recession at least partially overlapping the orifice of the combustion plate in a longitudinal direction at some point while the male combustion screw rotor is rotating.

2. The engine of claim 1, further comprising a compression valve affixed to the male compression screw rotor adjacent to the combustion plate, the compression valve comprising a thin plate with a plurality of petals, each petal of the plurality of petals of the compression valve associated with and covering a corresponding lobe of the male compression screw rotor, each petal of the plurality of petals of the compression valve extending beyond the corresponding lobe of the male compression screw rotor, adjacent petals of the plurality of petals of the compression valve separated from one another by a compression valve recession, each compression valve recession at least partially overlapping the orifice of the combustion plate in a longitudinal direction at some point while the male compression screw rotor is rotating.

3. The engine of claim 1, wherein the plurality of helically arranged flutes of the female combustion screw rotor and the plurality of helically arranged flutes of the female compression screw rotor each comprise six (6) flutes, and the plurality of helically-extending lobes of the male combustion screw rotor and the plurality of helically extending lobes of the male compression screw rotor each comprise four (4) lobes.

4. The engine of claim 1, wherein the plurality of helically-extending lobes of the male compression screw rotor are axially offset from the plurality of helically-extending lobes of the male combustion screw rotor at the combustion plate by an angle "α".

5. The engine of claim 4, where the angle "α" is between 20 and 60 degrees.

6. The engine of claim 1, further comprising a housing, the housing enclosing the compression portion, the combustion plate, and the combustion portion, the housing further configured to receive a sparking device.

7. The engine of claim 1, the combustion plate further comprising at least one substantially circular recession on opposing sides of the combustion plate, the each substantially circular recession configured to receive a circular protrusion extending from one of the female combustion screw rotor and the female compression screw rotor.

8. The engine of claim 7, wherein outer edges of the plurality of petals of the compression valve are contactable with the perimeter of the protrusion extending from the female compression screw rotor when the female compression screw rotor is rotating, and the outer edges of the petals of the combustion valve are contactable with the perimeter of the protrusion extending from the female combustion screw rotor when the female combustion screw rotor is rotating.

9. The engine of claim 1, wherein the respective lobes of the male compression screw rotor and the male combustion screw rotor each comprise a leading edge that curves to a trailing edge, and a recession between adjacent lobes of the male compression screw rotor and the male combustion screw rotor.

10. The engine of claim 9, wherein the trailing edge of each lobe of the plurality of helically-extending lobes of the male compression screw rotor and each lobe of the plurality of helically extending lobes of the male combustion screw rotor is aligned with a lobe-following edge of the respective valve of the lobe of the male compression screw rotor and the male combustion screw rotor.

11. An engine comprising:

a male compression screw rotor comprising a plurality of helically-extending lobes, the lobes extending at a pitch relative to a longitudinal axis of the rotor;

a male combustion screw rotor on the same longitudinal axis of the male compression screw rotor, the male combustion screw rotor comprising a plurality of helically-extending lobes extending the same pitch as the lobes of the plurality of helically extending lobes of the male compression screw rotor, the lobes of the male compression screw rotor axially clocked at an angle "α" to the lobes of the male combustion screw rotor a combustion plate;

a female compression screw rotor rotatably engaged with the male compression screw rotor, the female compression screw rotor comprising a plurality of helically-arranged flutes, the helically-arranged flutes of the female compression screw rotor receiving the lobes of the male compression screw rotor;

a female combustion screw rotor on a same longitudinal axis of the female compression screw rotor, the female combustion screw rotor rotatably engaged with the male combustion screw rotor, the female combustion screw rotor comprising a plurality of helically-arranged flutes, the helically-arranged flutes of the female combustion screw rotor receiving the lobes of the male combustion screw rotor;

a combustion plate disposed between the male and female compression screw rotors and the male and female combustion screw rotors, the combustion plate comprising an orifice configured to permit gas flow from a compression portion of the engine to a combustion portion of the engine;

a compression valve affixed to the male compression screw rotor adjacent to the combustion plate, the compression valve configured to regulate gas flow from the compression portion to the combustion portion while the male compression screw rotor, male combustion screw rotor, female compression screw rotor and female combustion screw rotor are rotating.

12. The engine of claim 11, the compression valve further comprising a thin plate with a plurality of petals, each petal covering a corresponding lobe of the male compression screw rotor, each petal extending beyond the corresponding lobe of the male compression screw rotor, adjacent petals separated from one another by a compression valve recession, the compression valve recession at least partially aligned with the orifice of the combustion plate in a longitudinal direction.

13. The engine of claim 11, where the angle "α" is between 20 and 60 degrees.

14. The engine of claim 11, further comprising a housing, the housing enclosing the compression portion, the combustion plate, and the combustion portion, the housing further configured to receive a sparking device.

15. An engine comprising:

a compression portion comprising a first pair of male and female twin-screw rotors;

a combustion portion comprising a second pair of male and female twin-screw rotors and a sparking device;

a combustion plate separating the compression portion from the combustion portion, the combustion plate configured to block flow of gas from the compression portion to the combustion portion, the combustion plate comprising an orifice configured to permit flow of a regulated amount of gas from the compression portion to the combustion portion for combustion.

16. The engine of claim 15, a male screw rotor of the first pair of male and female twin-screw rotors on the compression portion and a male screw rotor of the second pair of male and female twin-screw rotors on the combustion portion each comprising a plurality of helically-extending lobes, each of the helically-extending lobes of the compression portion and each of the helically-extending lobes of the combustion portion extending at a pitch relative to a common longitudinal axis of the male screw rotor on the compression portion and the male screw rotor on the combustion portion, the male screw rotor on the compression portion and the male screw rotor on the combustion portion sharing the common longitudinal axis, the plurality of helically-extending lobes of the male screw rotor in the compression portion axially docked at an angle "α" to the plurality of helically-extending lobes of the male screw rotor in the combustion portion.

17. The engine of claim 16, where the angle "α" is between 20 and 60 degrees.

18. The engine of claim 17, a female screw rotor of the first pair of male and female twin-screw rotors on the compression portion and a female screw rotor on the combustion portion of the second pair of male and female twin-screw rotors each comprising a plurality of helically-extending flutes, each of the flutes extending at a pitch relative to a common longitudinal axis of the female screw rotors, the female screw rotor on the compression portion and the female screw rotor on the combustion portion sharing the common longitudinal axis.

19. The engine of claim 18, the male screw rotor on the compression portion and the male screw rotor on the combustion portion each comprising a valve affixed to the respective male screw rotor adjacent to the combustion plate, the valve configured to regulate the flow of gas from the compression portion to the combustion portion while the rotors are rotating.

* * * * *